US006817033B2

(12) United States Patent
Bailey

(10) Patent No.: US 6,817,033 B2
(45) Date of Patent: Nov. 16, 2004

(54) GARMENT FOR AN INFANT

(75) Inventor: Tamara H. Bailey, Ogden, UT (US)

(73) Assignee: Angel Hugs LLC, South Ogden, UT (US)

( * ) Notice: Subject to any disclaimer, the term of this patent is extended or adjusted under 35 U.S.C. 154(b) by 0 days.

(21) Appl. No.: 10/272,500

(22) Filed: Oct. 16, 2002

(65) Prior Publication Data

US 2003/0079270 A1 May 1, 2003

Related U.S. Application Data

(60) Provisional application No. 60/329,625, filed on Oct. 17, 2001.

(51) Int. Cl.[7] ..... A41D 11/00
(52) U.S. Cl. ..... 2/69.5; 2/75; 2/80
(58) Field of Search ..... 2/69, 69.5, 79, 2/80, 83, 70, 71, 72, 73, 75, 84, 88, 86, 89, 227, 217, 111, 269, 115, 106, 270, 232; D6/611, 601; D2/719, 713, 728, 743; 5/416, 482, 655, 417, 419, 420, 494

(56) References Cited

U.S. PATENT DOCUMENTS

| | | | | | |
|---|---|---|---|---|---|
| 1,292,351 | A | * | 1/1919 | Milkes | 2/75 |
| 2,483,344 | A | * | 9/1949 | Kessner | 2/80 |
| 2,621,336 | A | * | 12/1952 | Wendroff | 2/227 |
| 2,670,471 | A | * | 3/1954 | Kaufman | 2/80 |
| 2,675,554 | A | * | 4/1954 | Gertz | 2/80 |
| 2,714,718 | A | * | 8/1955 | Kramer | 2/70 |
| 2,725,565 | A | * | 12/1955 | Wyner | 2/70 |
| 2,769,177 | A | * | 11/1956 | Berg | 2/80 |
| 3,477,065 | A | * | 11/1969 | Hoover | 2/69.5 |
| 3,812,539 | A | * | 5/1974 | Muehlberg et al. | 2/69.5 |
| 3,965,487 | A | * | 6/1976 | Mazur | 2/69.5 |
| D257,084 | S | | 9/1980 | Fuller et al. | |
| D257,085 | S | | 9/1980 | Fuller et al. | |
| D257,086 | S | | 9/1980 | Fuller et al. | |
| 4,573,218 | A | * | 3/1986 | Saggs | 2/93 |
| 4,611,353 | A | * | 9/1986 | Als et al. | 2/69 |
| 4,697,288 | A | * | 10/1987 | Palumbo | 2/269 |
| 4,726,076 | A | * | 2/1988 | Douez | 2/69 |
| 4,759,082 | A | * | 7/1988 | Mulligan | 2/69.5 |
| 4,773,101 | A | * | 9/1988 | Kapp et al. | 2/69.5 |
| 4,823,405 | A | * | 4/1989 | Porter | 2/80 |
| 4,856,131 | A | * | 8/1989 | Mills | 5/413 R |
| 4,897,885 | A | * | 2/1990 | Lunt | 2/69.5 |
| 4,928,321 | A | * | 5/1990 | Dobson | 2/84 |
| D312,549 | S | | 12/1990 | Perdelwitz, Jr. et al. | |
| D312,550 | S | | 12/1990 | Rankin et al. | |
| D313,525 | S | | 1/1991 | Perdelwitz, Jr. | |
| D313,526 | S | | 1/1991 | Rankin et al. | |
| D313,527 | S | | 1/1991 | Perdelwitz, Jr. et al. | |
| D313,528 | S | | 1/1991 | Perdelwitz, Jr. | |
| D313,723 | S | | 1/1991 | Rankin et al. | |
| 4,993,090 | A | | 2/1991 | Ranalli | |
| 5,023,952 | A | * | 6/1991 | Palmer | 2/69 |
| 5,046,204 | A | | 9/1991 | Mohler | |
| 5,058,226 | A | | 10/1991 | Crosby | |
| 5,129,406 | A | * | 7/1992 | Magnusen et al. | 128/873 |
| 5,315,716 | A | * | 5/1994 | Baum | 2/227 |
| 5,367,709 | A | * | 11/1994 | Teasley | 2/69 |
| 5,418,979 | A | * | 5/1995 | Senderowicz | 2/75 |

(List continued on next page.)

OTHER PUBLICATIONS

"Teddy Toes" Product identification and instruction tag for a 'Blanket with Feet'.

(List continued on next page.)

*Primary Examiner*—John J. Calvert
*Assistant Examiner*—Alissa L. Hoey
(74) *Attorney, Agent, or Firm*—Morriss O'Bryant Compagni, P.C.

(57) ABSTRACT

A garment for enclosing an infant or small child is structured to be selectively adjustable in length to accommodate infants of various sizes or increasing growth, and is configured to facilitate use of the garment with car seats or carriers while also being structured to provide cushioning for the child while in the car seat or carrier.

15 Claims, 4 Drawing Sheets

U.S. PATENT DOCUMENTS

| | | | | | |
|---|---|---|---|---|---|
| D362,742 | S | * | 10/1995 | Bergman | D2/745 |
| 5,535,449 | A | * | 7/1996 | Dickey | 2/69 |
| D376,505 | S | | 12/1996 | O'Brien | |
| 5,611,095 | A | | 3/1997 | Schneider | |
| D380,589 | S | * | 7/1997 | Westman | D2/719 |
| 5,708,977 | A | * | 1/1998 | Morkunas | 2/80 |
| 5,722,094 | A | | 3/1998 | Ruefer | |
| D395,188 | S | * | 6/1998 | Rush | D6/603 |
| 5,781,946 | A | | 7/1998 | McEntire et al. | |
| D400,688 | S | * | 11/1998 | Federspiel | D2/719 |
| D405,635 | S | * | 2/1999 | Cohen et al. | D6/603 |
| 5,916,089 | A | * | 6/1999 | Ive | 5/655 |
| 5,950,261 | A | * | 9/1999 | Hay et al. | 5/482 |
| 6,009,576 | A | * | 1/2000 | Gramme et al. | 5/413 R |
| 6,018,830 | A | * | 2/2000 | Howe | 5/413 R |
| 6,055,686 | A | * | 5/2000 | Knight | 5/494 |
| 6,058,508 | A | * | 5/2000 | Brown Honeysuckle | 2/69 |
| 6,145,932 | A | * | 11/2000 | Hamel-Nyhus et al. | 297/465 |
| 6,223,352 | B1 | * | 5/2001 | Watlington | 2/80 |
| 6,266,822 | B1 | * | 7/2001 | Joyce | 2/83 |
| D448,914 | S | * | 10/2001 | Caudill | D2/719 |
| 6,317,894 | B1 | * | 11/2001 | Blechman | 2/269 |
| 6,341,397 | B1 | * | 1/2002 | Kliegl et al. | 5/482 |
| 6,389,597 | B1 | * | 5/2002 | Henegan | 2/69.5 |
| 6,394,543 | B1 | * | 5/2002 | Dunne et al. | 297/219.12 |
| 6,401,248 | B1 | * | 6/2002 | Christensen | 2/69 |
| 6,408,439 | B1 | * | 6/2002 | Garforth-Crippen | 2/80 |

OTHER PUBLICATIONS

"One Step Ahead" Catalog pages showing a 'Fitted Baby Blanket' on p. 47.

"SeasonsShop" Catalog page showing a 'Star Bunting'—Item D.

"www.peekaboocanada.com"—web page showing a 'peekaboo kangaroo' cover.

"BabyCover" web page showing a variety products.

"www.babysimage.com" web page showing a 'Custom Fitted Baby Blanket'.

"www.snugglewool.com" web page showing a 'bunt'.

"www.hemstitcher.com" web page showing 'Car seat Blankets'.

"www.bellabambini.com" web page showing 'The "Everthing" Blanket'.

"www.babybundlesbycarol.com" web page showing the 'Baby Bundle'.

* cited by examiner

GARMENT FOR AN INFANT

CROSS-REFERENCE TO RELATED APPLICATION

This application is a non-provisional application claiming priority to provisional application Ser. No. 60/329,625 filed Oct. 17, 2001.

BACKGROUND

1. Field of the Invention

This invention relates to garments for infants and specifically relates to a length-adjustable bunting-type article which is structured to enclose an infant or small child, and is especially adapted for use with infant carriers and car seats.

2. Description of Related Art

Given the need and desire to protect infants or small children from the elements, and particularly cold environments, various blankets and bunting-type garments have been used through the years to wrap or enclose children and small infants. The very earlier types of enclosures were simply blankets that were flat pieces of fabric which could be wrapped in some manner about the child. Later, blankets began to be more specially configured to adapt to the form of a baby or child to provide greater protection. Such adaptations are generally referred to as buntings.

Numerous baby-enclosing structures, or bunting-type articles, that are adapted from the concept of a flat blanket have been disclosed. Examples of such bunting-type articles are disclosed in U.S. Pat. No. 5,046,204 to Mohler, U.S. Pat. No. 5,058,226 to Crosby and U.S. Pat. No. 5,722,094 to Ruefer. Each of the articles described in those patents comprises a foot or leg enclosure portion and flattened, enlarged side portions to wrap around the body of the child. While each of the disclosed devices is suitable for its purpose, none is particularly well-adapted to use in a child's carrier or car seat because the configuration of the article, particularly the enlarged, child-enveloping side portions, produce a bulky aggregate of material which does not enable a child, wrapped in the article, to be positioned comfortably in a carrier or car seat.

Others have developed child-enveloping bunting-type articles with a thought to adapting the article's configuration to use with a child carrier or car seat. Specifically, bunting-type articles have been developed which provide holes or cut-out portions to accommodate the harnessing structures of a car seat or carrier. Examples of such devices are described in U.S. Pat. No. 5,781,946 to McEntire, et al., and U.S. Pat. No. 5,611,095 to Schneider. Even with such specially configured articles, it can be seen that they require complicated placement and attachment of the article to the carrier and do not easily facilitate placement of the child in the bunting-like article.

Still others have developed car seat or carrier device covers or pads which are especially adapted to providing a cushion for the child while in the carrier or car seat. Examples of such covers or pads are disclosed in U.S. Pat. No. 4,993,090 and U.S. Pat. No. Design Pat. Nos. D257,086; D312,550; D312,549; D313,528; D313,723 and D376,505. However, none of the covers or pads disclosed in the foregoing patents are configured to enclose the child nor provide any protection from the cold.

All known bunting-type articles are similar in that they are of a fixed longitudinal length. Therefore, if a bunting-type article is purchased to accommodate a very small infant, such as a newborn, the article will soon be obsolete as the child grows, and a new bunting-type article of greater length and size will be required. Alternatively, a larger size bunting article can be purchased for a small infant or newborn, but the child will be overwhelmed by the size of the article until the child grows into its dimensions. Consequently, the oversized bunting-type article is also difficult to adapt for use in a car seat or carrier because excess material interferes with the securing the car seat or carrier harness about the child and the bunting-type article.

Thus, it would be advantageous in the art to provide a child-enclosing, bunting-type article that is structured to be selectively adjustable in overall length to accommodate children or infants of varying sizes, which is especially configured to facilitate placement of the child in a car seat or carrier and which provides the cushioning elements of a car seat or carrier pad.

BRIEF SUMMARY OF THE INVENTION

In accordance with the present invention, a garment for enclosing an infant or small child is structured to be selectively adjustable in length to accommodate infants of various sizes or increasing growth, and is configured to facilitate use of the garment with car seats or carriers while also being structured to provide cushioning for the child while in the car seat or carrier.

The garment of the present invention is generally comprised of an infant-enclosing structure having a body portion for receiving the infant. The body portion is generally of a selected length and is structured with length-adjusting apparatus which allows the overall length of the garment to be selectively sized or adjusted to accommodate a child of given length. The length-adjusting apparatus preferably provides shortening of the length of the garment in a manner which evenly distributes the material of the garment to avoid excessive bunching of the material.

The garment of the present invention may further be structured with opposing body-enclosing members connected to the body portion in a manner which allows the garment to be wrapped about the infant to enclose the infant therein. The opposing body-enclosing members, also referred to herein as "wings," are structured or attached to the body portion in a manner that enables the garment to be used in a car seat or carrier having a five-point attachment harness. The configuration of the opposing wings thus allows the child to be secured into the car seat or harness without causing a bunching-up of the material of the garment, and allows the opposing wings to be drawn back from the child or rolled into a position to provide cushioning for the infant without impeding the five-point attachment harness of the car seat or carrier.

The garment may further be structured with a leg-enclosing portion for adapting the garment to the child and to the harnessing construction of a car seat or carrier. In a preferred embodiment, the leg-enclosing portion has a waist band adaptable to the body of the infant and has selectively closeable side openings to facilitate placement of the infant in the garment. The garment may further include a head-covering portion connected to the body portion to cover the head of the infant. The head-covering portion is preferably configured to be adjusted and positioned to provide cushioning to the head of the infant while in a car seat or carrier.

In an alternative embodiment of the present invention, the garment is further provided with a garment liner which is configured to overlay the body portion of the garment, including the opposing body-enclosing portions and head-covering portion. The garment may also include a jacket sized to be received within the body portion and opposing body-enclosing portions to further insulate the infant from the elements.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
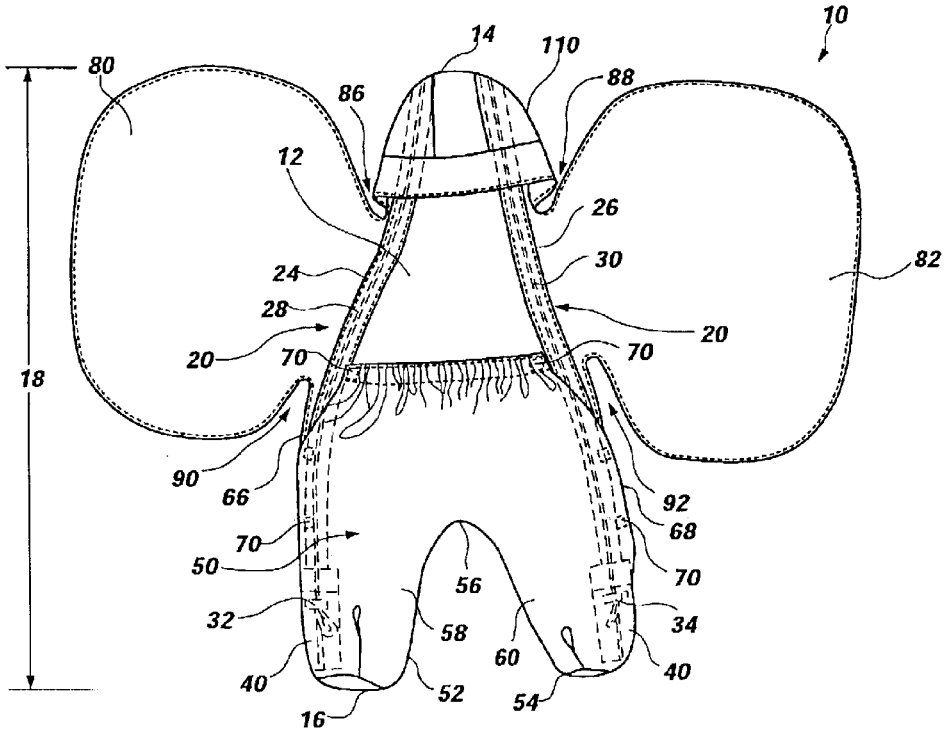
FIG. 1 is a plan view of the bunting-type garment of the present invention with certain structural elements shown in phantom.

The garment 10 of the present invention is illustrated in FIG. 1 and depicts the garment 10 in an expanded or laid-out manner ready to receive an infant. The garment comprises a body portion 12 which is configured to receive the body of the infant thereon. The body portion 12 of the garment 10 generally extends from a first end 14, which is oriented to receive the infant's head, to a second end 16 which is oriented toward the infant's feet. The body portion 12 thus defines a selected length 18 that extends from the first end 14 to the second end 16 of the body portion 12.

The garment 10 is structured with length-adjusting apparatus 20 which enables the overall length 18 of the garment to be selectively decreased to accommodate infants of varying length or increasing growth. In the embodiment of the invention illustrated, the length-adjusting apparatus 20 comprises two enclosed seams 24, 26, one on either side of the body portion 12, which extend from near the first end 14 of the garment 10 to near the second end 16 of the garment 10. Each enclosed seam 24, 26 houses a drawstring 28, 30 (shown in phantom) which is secured to the garment 10 near the first end 14 thereof and is also secured to the garment 10 near the second end 16 thereof. The drawstrings 28, 30 are each fitted with a locking pull member 32, 34, the function of which is described more fully hereinafter.

Figure 2:
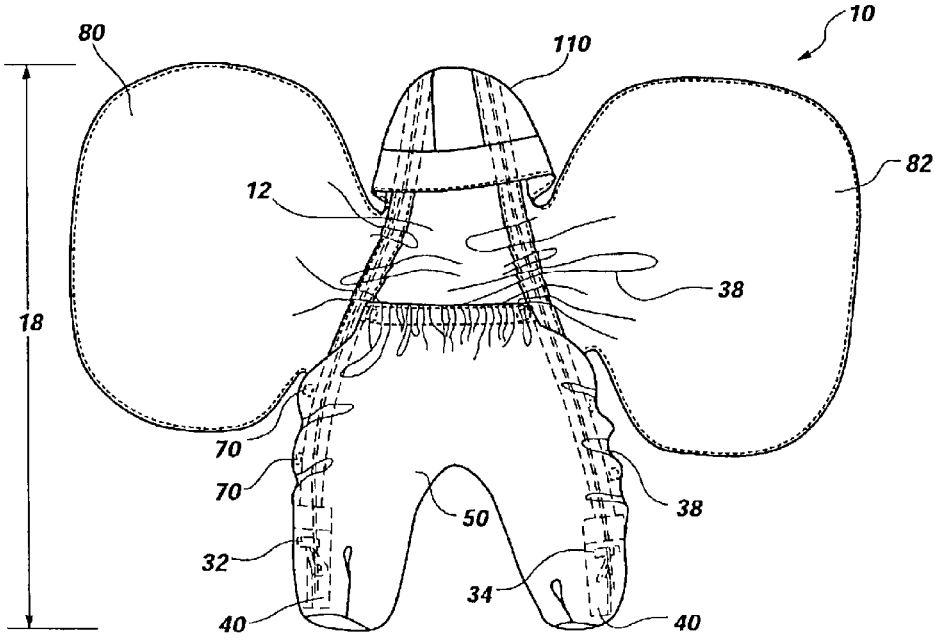
FIG. 2 is a plan view of the garment shown in FIG. 1 illustrating the selected length adjustability of the garment, with certain structural elements shown in phantom.

Pulling the drawstrings 28, 30 causes the overall length 18 of the body portion 12 to compress or shorten, as illustrated further in FIG. 2. It can be seen from FIG. 2 that as the body portion 12 shortens due to the pulling of the drawstrings 23, 30, the body portion begins to form gentle folds 38 along its length 18. The gentle folds 38 allow the garment to shorten in length without causing a significant accumulation of material in one place along the length 18 of the garment 10.

Figure 3:
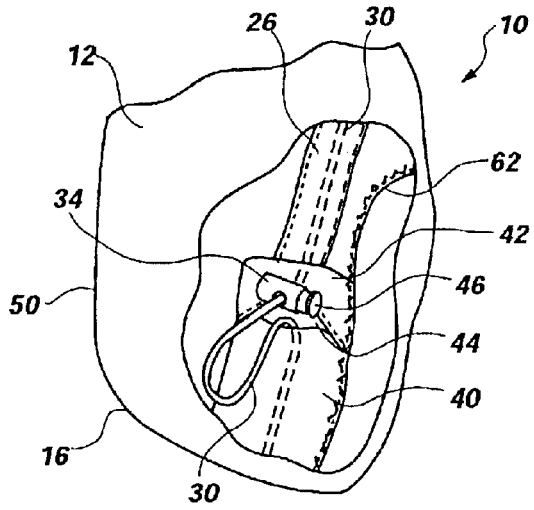
FIG. 3 is an enlarged view of one foot portion of the garment showing, in breakaway, the adjustment apparatus of the invention.

As shown more fully in FIG. 3, which illustrates, in partial cut-away, an enlarged view of the second end 16 of the garment 10, it can be seen that a pocket 40 is formed in the garment 10 in alignment with each enclosed seam 26 (only one enclosed seam 26 is illustrated in FIG. 3, but it is understood to be representative of both enclosed seams 24, 26). The drawstring 30 extends through the enclosed seam 26 and associated pocket 40. A locking pull member 34 is secured to the drawstring 30 to facilitate the pulling of the drawstring 30. The pocket 40 is preferably formed with a placket 42 which overlaps the pocket 40 to form a closeable opening 44.

The locking pull member 34 is housed within the pocket 40 and is accessible through the closeable opening 44 by slightly lifting the placket 42 to reveal the opening 44. When the length of the garment 10 is to be shortened, the locking pull member 34 is extracted from the opening 44 and the detent 46 of the locking pull member 34 is depressed to allow the drawstring 30 to be pulled through the locking pull member 34 a selected distance. When an amount of drawstring 30 is pulled through the locking pull member 34 sufficient to shorten the garment 10 to a desired length, the detent 46 is released causing the locking pull member 34 to secure the drawstring 30 in place. The locking pull member 34 and drawstring 30 are then tucked through the opening 44 to be housed within the pocket 40 and away from possible entanglement with the infant's foot, which is housed in the region of the second end 14. The length-adjusting apparatus 20 described herein is but one example and any number of other means may be employed to shorten the length 18 of the garment 10 as described.

Referring again to FIGS. 1 and 2, the garment 10 may further be configured with a leg-enclosing portion 50 having feet-receiving portions 52, 54 for receipt of the child's feet therein, and a crotch portion 56 distinguishing a right leg portion 58 and a left leg portion 60. The leg-enclosing portion 50 is preferably attached to the body portion 12 by a seam 62 (FIG. 3) which provides side slits 66, 68 on either side of the leg-enclosing portion 50. The slits 66, 68 facilitate placement of the child within the garment 10 and facilitates access to the infant for the changing of diapers and the like. The slits 66, 68 may be held closed by, for example, a plurality of tabs 70 of hook and loop material, or any other suitable closure device. The leg-enclosing portion 50 also may preferably be formed with a waistband 72 for fitting the garment to the child. The waistband 72 may preferably be adjustable by such means as elastic or a drawstring.

Figure 4:
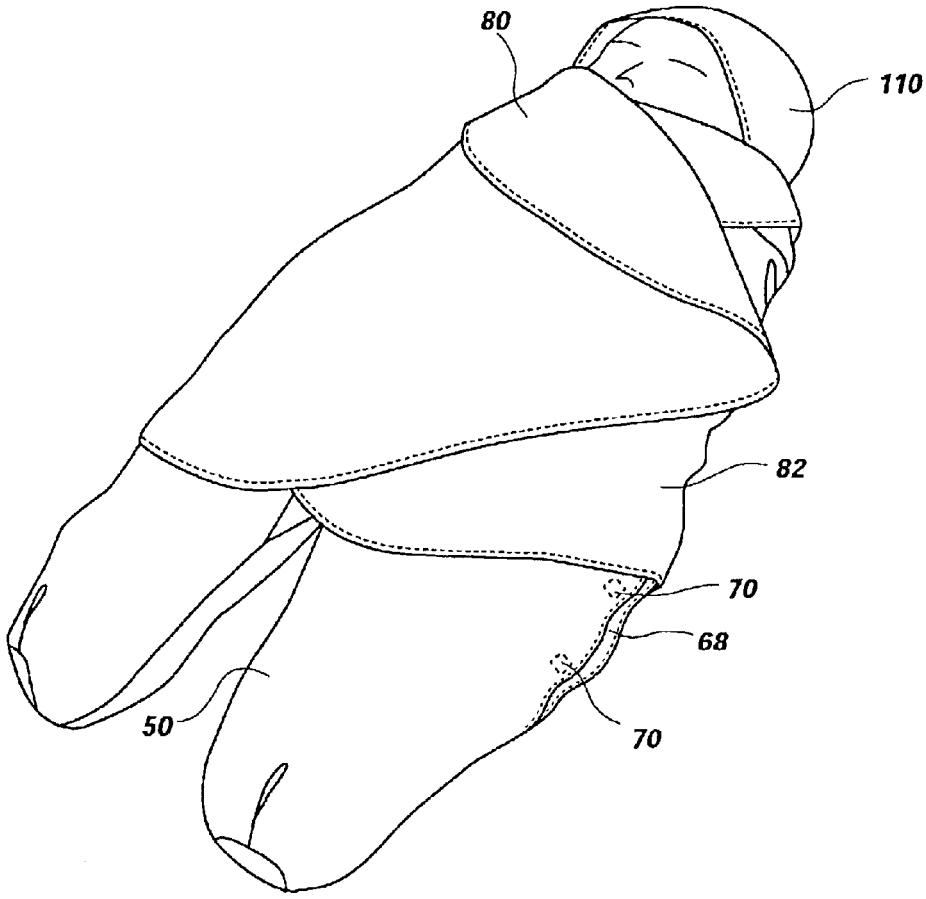
FIG. 4 is a view in perspective illustrating how the garment is positioned to enclose an infant.

The garment 10 of the present invention is further configured with opposing body-enclosing members, or wings 80, 82, which are generally sized and shaped to fold about the infant to enclose the infant within the garment 10, as illustrated more fully in FIG. 4. The wings 80, 82 may be any suitable shape, but are preferably rounded as shown to provide enclosure of the infant and to maximize the cushioning feature of the invention as described more fully hereinafter. The wings 80, 82 are formed with, or connected to, the body portion 12 of the garment 10 in a manner which facilitates use of the garment in a five-point harness car seat or carrier. Specifically, the wings 80, 82 are configured in association with the body portion 12 such that an upper cleft 86, 88 is provided between each respective wing 80, 82 and the body portion 12. Likewise, a lower cleft 90, 92 is formed between each respective wing 80, 82 and the body portion 12.

Figure 5:
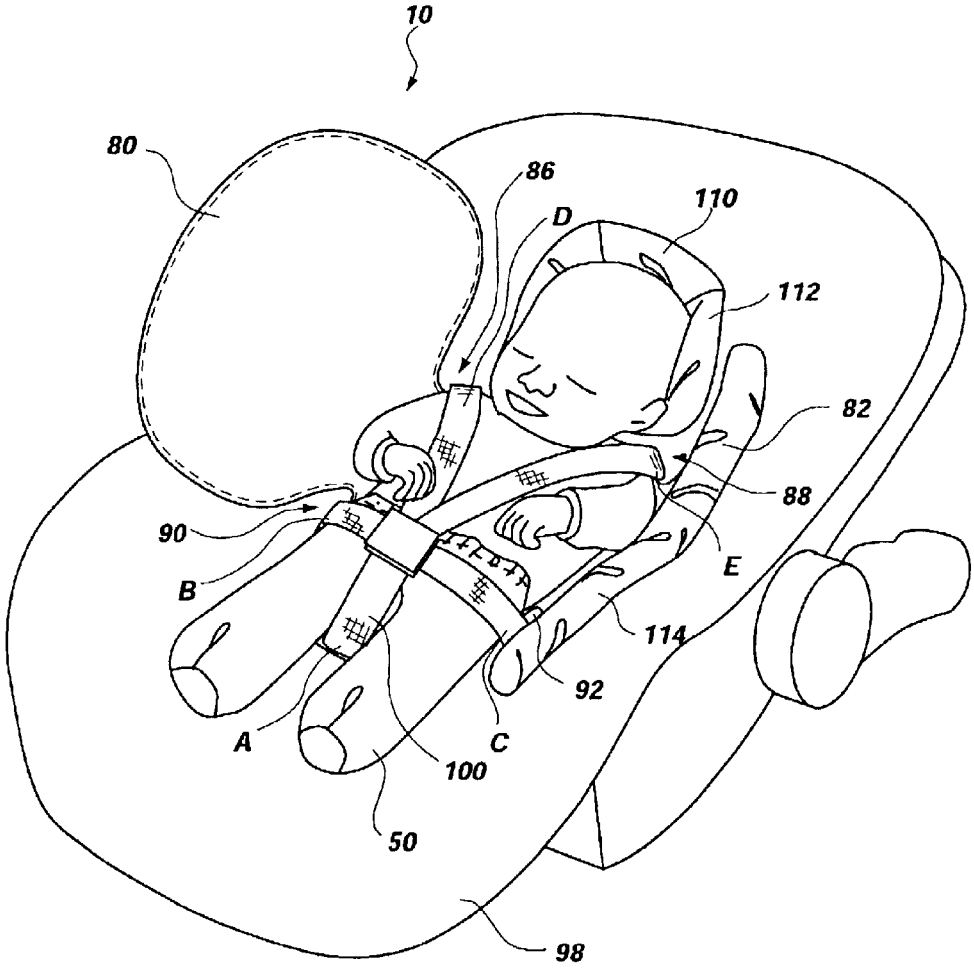
FIG. 5 is a view in perspective illustrating how the invention operates structurally to provide cushioning of a child in a car seat.

Thus, as illustrated more clearly in FIG. 5, the configuration of the garment 10 facilitates its use with a car seat 98, particularly of the type having a five-point harness construction as is now required by law in many states. A car seat 98 having a five-point harness construction is illustrated in FIG. 5 where the harness 100 connects to the body of the car seat at points A, B, C, D and E, where point A is positioned between the child's legs, points B and C are positioned on either side of the child's body in the region of the hips and points D and E are positioned above the shoulders of the child. The upper clefts 86, 88 of the garment 10, therefore, accommodate the harness at points D and E while the lower clefts 90, 92 of the garment 10 accommodate the harness at points B and C. Consequently, the garment 10 lays smoothly within the car seat 98 (or carrier) and does not bunch up around the harness connector points A, B, C, D, E.

Referring again to FIGS. 1 and 2, the garment 10 of the present invention may be formed with a head-covering portion 110 to protect the infant's head. The head-covering portion 110 may take any form, but is illustrated as being a hood. The head-covering portion 110 may by structured with an adjustment means for fitting that portion to the infant's head.

Referring again to FIG. 5, it can be seen that not only is the garment 10 ideally configured for use in a car seat or carrier, but the garment 10 is also configured to provide cushioning to the infant within the car seat or carrier, thereby enhancing the cushioning already provided in car seats or carriers, or allowing the elimination of additional and expensive car seat pads or liners. Cushioning of the infant is provided in the garment 10 by rolling the head-covering portion 110 back upon itself to form an encircling cushion 112. Additionally, cushioning is provided by rolling the wings 80, 82 under or over and tucking the rolled mass 114 beneath the sides of the infant to form side cushions for the body as illustrated.

Figure 6:
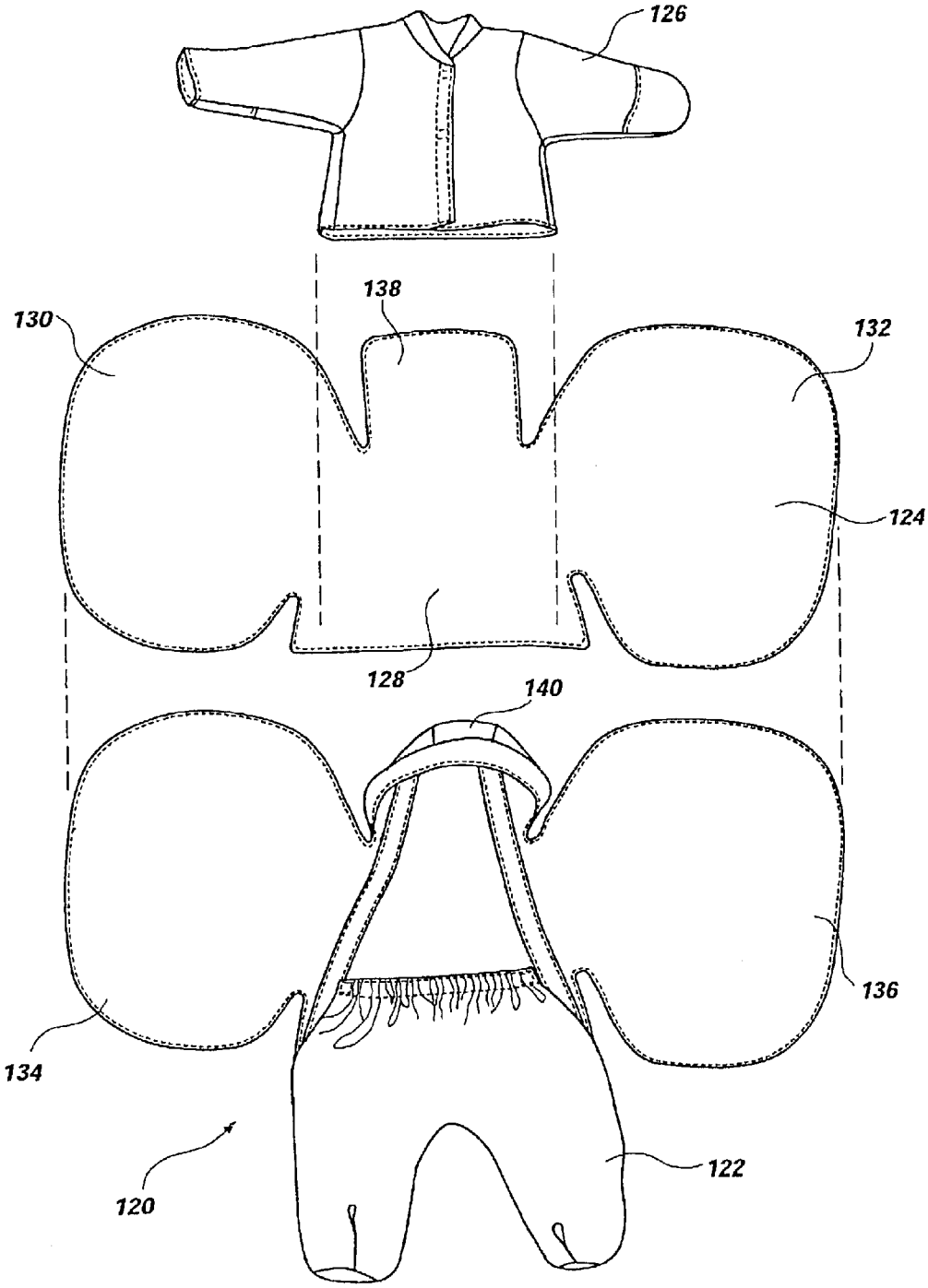
FIG. 6 is an exploded view of an alternative embodiment of the invention illustrating an auxiliary liner and jacket.

In an alternative embodiment of the invention, as shown in FIG. 6, the garment 120 may comprise an infant-enclosing member 122 as previously described and may further include a liner 124 and jacket 126 which are positioned within the infant-enclosing member 122. The liner 124 comprises a body section 128 from which are extended wing sections 130, 132 that overlay and approximate the size, shape and/or dimension of the wing portions 134,136 of the infant-enclosing member 122. The liner 124 may further comprise a head section 138 which is positionable against or within the head-covering portion 140 of the infant-enclosing member 122. The liner 124 provides a further layer of protection and insulation to the child.

The alternative embodiment of the invention shown in FIG. 6 further comprises a jacket 126 which is sized to receive the upper body portions of an infant and which is sized to be received in the inner liner 124 of the garment 120. The jacket 126 provides even greater protection for and insulation of the infant within the garment 120.

The garment of the present invention may be made of any suitable material that protects the child from the elements, including woven, natural and synthetic materials. The garment may also be adapted for use in any number of baby-containing devices, such as car seats, carriers, strollers and various play equipment, such as swings or walkers. Hence, reference herein to specific details of the structure and function of the garment is by way of reference only and not by way of limitation. Those skilled in the art will recognize that changes may be made to the invention to adapt it to a variety of suitable purposes.

What is claimed is:

1. An adjustable infant-enclosing garment, comprising:

a body portion having a first end for receiving the head of an infant and a second end for receiving the feet of an infant and having a selected length extending between said first end and said second end;

opposing body-enclosing members configured as wing-like flaps extending laterally from said body portion;

an upper cleft and a lower cleft positioned between each said opposing body-enclosing member and said body portion, each said upper cleft being oriented toward the lower cleft in closest proximity thereto and each said lower cleft being oriented toward the upper cleft in closest proximity thereto; and length-adjusting apparatus extending continuously from said second end to said first end for selectively adjusting said length of said body portion from said head-receiving first end to said feet-receiving second end.

2. The adjustable infant-enclosing garment of claim 1 further comprising a leg-enclosing portion connected to said body portion.

3. The adjustable infant-enclosing garment of claim 2 further comprising a head-covering portion extending from said body portion.

4. An adjustable infant-enclosing garment, comprising:

a body portion having a selected length;

a leg-enclosing portion of said body portion;

opposing body-enclosing members configured as wing-like flaps extending from said body portion, an upper cleft and a lower cleft positioned between each said opposing body-enclosing member and its respective attachment to said body portion, each said upper cleft being oriented toward the lower cleft in closest proximity thereto and each said lower cleft being oriented toward the upper cleft in closest proximity thereto; and length-adjusting apparatus for selectively adjusting said length of said body portion.

5. The adjustable infant-enclosing garment of claim 4 further comprising a head covering portion extending from said body portion.

6. The adjustable infant-enclosing garment of claim 4 wherein said length-adjusting apparatus extends said length of said body portion.

7. The adjustable infant-enclosing garment of claim 4 wherein said length-adjusting apparatus comprises at least one enclosed seam housing an adjustable drawstring extending said length of said body portion to provide adjustment of said length.

8. The adjustable infant-enclosing garment of claim 4 wherein said leg-enclosing portion is connected to said body portion to provide closeable slits on either side of said body portion.

9. The adjustable infant-enclosing garment of claim 8 wherein said closeable slits are provided with closure devices for securing said slits in a closed position.

10. An adjustable infant-enclosing garment, comprising:

a body portion having a first end for receiving the head of an infant and a second end for receiving the feet of an infant and having a selected length between said first end and said second end;

a leg-enclosing portion of said body portion;

opposing body-enclosing members configured as wing-like flaps extending from said body portion;

length-adjusting apparatus for selectively adjusting said length of said body portion between said first end and said second end; and a separable inner liner having a body section configured to overlay said body portion and having opposing body-enclosing sections sized and configured to overlay said opposing body-enclosing members.

11. The adjustable infant-enclosing garment of claim 10 further comprising a jacket sized to receive an infant and positioned to overlay said separable inner liner.

12. The adjustable infant-enclosing garment of claim 10 further comprising a head-covering portion extending from said body portion and wherein said inner liner further comprises a head section positioned to overlay at least in part said head-covering portion.

13. The adjustable infant-enclosing garment of claim 10 wherein said leg-enclosing portion further comprises an adjustable waistband.

14. The adjustable infant-enclosing garment of claim 10 further comprising an upper cleft and a lower cleft positioned between each said opposing body-enclosing member and said body portion.

15. The adjustable infant-enclosing garment of claim 14 wherein said inner liner further comprises an upper cleft and a lower cleft positioned between each said opposing body-enclosing section and said body section of said inner liner.

* * * * *